US010799950B2

(12) United States Patent
Fukunaga et al.

(10) Patent No.: US 10,799,950 B2
(45) Date of Patent: Oct. 13, 2020

(54) NOZZLE STRUCTURE

(71) Applicant: KROSAKIHARIMA CORPORATION, Fukuoka (JP)

(72) Inventors: Shinichi Fukunaga, Fukuoka (JP); Takahiro Kuroda, Fukuoka (JP); Takashi Sadano, Fukuoka (JP); Takuya Okada, Fukuoka (JP); Arito Mizobe, Fukuoka (JP)

(73) Assignee: KROSAKIHARIMA CORPORATION, Fukuoka (JP)

( * ) Notice: Subject to any disclaimer, the term of this patent is extended or adjusted under 35 U.S.C. 154(b) by 159 days.

(21) Appl. No.: 16/070,934

(22) PCT Filed: Nov. 9, 2016

(86) PCT No.: PCT/JP2016/083186

§ 371 (c)(1),
(2) Date: Jul. 18, 2018

(87) PCT Pub. No.: WO2017/130517

PCT Pub. Date: Aug. 3, 2017

(65) Prior Publication Data

US 2019/0030599 A1 Jan. 31, 2019

(30) Foreign Application Priority Data

Jan. 25, 2016 (JP) ..... 2016-011775

(51) Int. Cl.
*B22D 41/50* (2006.01)
*B22D 11/10* (2006.01)

(52) U.S. Cl.
CPC ..... *B22D 41/50* (2013.01); *B22D 11/10* (2013.01)

(58) Field of Classification Search
CPC ..... B22D 11/10; B22D 41/50
(Continued)

(56) References Cited

U.S. PATENT DOCUMENTS 5,348,275 A 9/1994 Soofi
5,397,105 A 3/1995 Soofi
(Continued)

FOREIGN PATENT DOCUMENTS

DE 19818028 10/1998
JP 56-19970 2/1981
(Continued)

OTHER PUBLICATIONS

International Search Report dated Jan. 30, 2017 for International Application No. PCT/JP2016/083186 filed Nov. 9, 2016.
(Continued)

*Primary Examiner* — Jessee R Roe
*Assistant Examiner* — Michael Aboagye
(74) *Attorney, Agent, or Firm* — Paul D. Bianco; Gary S. Winer; Fleit Intellectual Property Law

(57) ABSTRACT

A nozzle structure for discharging molten steel with improved sealing performance. The nozzle structure comprises: a molten steel discharge path having an inner bore; and one or more joints through which the molten steel discharge path is divided at one or more positions in a orthogonal direction with respect to an upward-downward direction of discharge of molten steel, and which join the molten steel discharge path. An inner bore sleeve is formed of a refractory material, and provided on an inner bore surface of the nozzle structure to extend in the upward-downward direction across at least one of the joints.

14 Claims, 8 Drawing Sheets

(58) Field of Classification Search
USPC ..... 222/590, 591, 600, 606, 607; 236/236, 236/280, 286; 164/437, 488
See application file for complete search history.

(56) References Cited

U.S. PATENT DOCUMENTS

| | | | | |
|---|---|---|---|---|
| 5,723,055 | A * | 3/1998 | Janssen | B22D 41/58 222/603 |
| 5,992,711 | A * | 11/1999 | Mochizuki | B22D 41/52 222/606 |
| 7,172,013 | B2 * | 2/2007 | Ogata | B22D 41/54 164/437 |
| 7,275,584 | B2 * | 10/2007 | Morikawa | B22D 41/507 164/437 |
| 9,221,099 | B2 * | 12/2015 | Morikawa | B22D 41/505 |
| 2010/0084441 | A1 | 4/2010 | Morikawa | |

FOREIGN PATENT DOCUMENTS

| | | |
|---|---|---|
| JP | 7-51839 | 2/1995 |
| JP | 9-220649 | 8/1997 |
| JP | 11-5145 | 1/1999 |
| JP | 11-104814 | 4/1999 |
| JP | 2002-153970 | 5/2002 |
| JP | 2010-36229 | 2/2010 |

OTHER PUBLICATIONS

Written Opinion for International Application No. PCT/JP2016/083186 filed Nov. 9, 2016.
International Preliminary Report with Written Opinion dated Jul. 31, 2018 for International Application No. PCT/JP2016/083186 filed Nov. 9, 2016.

* cited by examiner

NOZZLE STRUCTURE

TECHNICAL FIELD

The present invention relates to a nozzle structure for discharging molten steel.

BACKGROUND ART

For example, for discharging molten steel from a tundish, a nozzle structure as a molten steel discharge path from a molten steel inlet port to a casting mold may comprise a refractory body ("nozzle body") which is divided into a plurality of refractory members ("nozzle members") in a direction orthogonal to a direction of discharge of molten steel (upward-downward direction).

In the nozzle structure in which the plurality of refractory members are combined, one or more joints are inevitably present between the refractory members. For the nozzle member involving sliding such as sliding nozzle, the joints cannot be used with joint filling material and sealant, so that they have a contact structure, which are so-called "dry joints". And for other nozzle members without sliding, the joints are often provided with mortar or sealing material. However, even in varying degrees depending on the presence or absence of the joint filling material and the like, outside air is prone to be drawn into an inner bore of the nozzle structure from the joints (see FIG. 13). When the outside air is drawn, there are caused depositing or clogging of alumina inclusions or the like on or in the inner bore, increase in oxides, quality deterioration of other steels, etc.

As solution to drawing of the outside air, as shown in FIG. 14, for example, it is possible to adopt a nozzle structure in which the flow rate control function is performed not by a nozzle body, but by a stopper 7 provided at a top of the nozzle body, wherein the nozzle body is formed as an integral immersion nozzle with no joint. However, in continuous casting of steel, a casting time tends to extend for a long time due to multi-sequential continuous casting or the like, so that, in order to replace a part of the nozzle structure such as an immersion nozzle or the like, a nozzle body comprising a plurality of divided refractory members (nozzle members) may still be required in some cases. In such a case, joints should still be present.

As solution to drawing of the outside air at the joints, Patent Document 1 discloses the following invention:

a casting nozzle which comprises a refractory nozzle body for the casting nozzle and a case provided on an outer periphery of the refractory nozzle body, wherein a metal pipe having a plurality of gas blowing holes or slits is provided in a gap formed between the refractory nozzle body and the case so as to cover at least a portion of the outer periphery or an inner periphery of the refractory nozzle body, and wherein a gas is introduced from at least one end of the metal pipe through the gas blowing holes or slits to thereby gas-seal a peripheral vicinity of the refractory nozzle body.

CITATION LIST

[Parent Document]

[Patent Document 1] JP H11-104814A

SUMMARY OF INVENTION

Technical Problem

In Patent Document 1, gas-sealing is performed by introducing the gas (inert gas), so that the risk of drawing the outside air, or oxygen which is particularly harmful to the molten steel can be reduced. However, the gas (inert gas) is still drawn. Thus, when gas (inert gas) is drawn, various problems associated with oxidation of molten steel and refractory body is reduced, but there still remains a risk that quality defects such as pinholes may be caused in the steel.

The problem to be solved by the present invention is to improve sealing performance in a nozzle structure for discharging molten steel which comprises a plurality of refractory members and one or more joints.

Solution to Technical Problem

The present invention provides nozzle structures 1 to 7 as below.

1. A nozzle structure for discharging molten steel, wherein the nozzle structure comprises:

a molten steel discharge path;

one or more joints through which the molten steel discharge path is divided at one or more positions in a orthogonal direction with respect to an upward-downward direction of discharge of molten steel, and which join the molten steel discharge path;

an inner bore sleeve formed of a refractory material, and provided on an inner bore surface of the nozzle structure to extend in the upward-downward direction across at least one of the joints.

2. The nozzle structure as described in above 1, wherein the inner bore sleeve is provided on the inner bore surface via an adhesive.

3. The nozzle structure as described in above 1 or 2, wherein an inner bore-side upper end of the inner bore sleeve has a curved or inclined surface.

4. The nozzle structure as described in any of above 1 to 3, wherein the inner bore sleeve comprises one or more non-continuous recesses or continuous grooves provided on an outer periphery of the inner bore sleeve at a position opposed to each of the one or more joints in the orthogonal direction.

5. The nozzle structure as described in above 4, among the one or more non-continuous recesses or continuous grooves, an area of the recesses or continuous grooves which are arranged on at least one of front and back surfaces of the inner bore sleeve along a sliding direction of a nozzle or along a pressure-applied direction for disassembling and removing the nozzle below the joints, is relatively greater than that of the remaining recesses or continuous grooves.

6. The nozzle structure as described in any of above 1 to 5, the refractory material of the inner bore sleeve has higher anti-deposition capability than that of a nozzle body of the nozzle structure.

7. The nozzle structure as described in above 6, wherein the inner bore sleeve is composed of a refractory material containing about 15 mass % or more of a CaO component and a remainder including MgO, wherein a mass ratio of CaO/MgO is the range of 0.1 to 1.5.

Effect of the Invention

According to the present invention, the nozzle structure comprising an inner bore sleeve provided on an inner bore surface of the nozzle structure body so as to extend across at least one of the joints in the upward-downward direction, can achieve an enhanced sealing performance. Further, the nozzle structure comprising an inner bore sleeve which is provided so as to extend across all of the joints in the upward-downward direction, can achieve the same degree of sealing performance as an integral nozzle structure with no joint.

Further, the inner bore sleeve has the recesses or the grooves on the outer periphery thereof, so that even in the case of breaking and detaching the nozzle member at a specific location of the nozzle structure, it is possible to securely and accurately separate the nozzle member at a given portion without harming the sealing property. Thereafter, even in the case of attaching the replacement article, it is possible to reduce the unevenness of the joining surface and maintain the joining precision at a high level, and to easily perform the detachment and attachment work of the nozzle member.

Moreover, the nozzle structure of the present invention makes it possible to freely and easily select and apply refractories having various materials and physical properties, which are different in damages on the inner bore surface and characteristics of deposition of alumina inclusions and the like.

BRIEF DESCRIPTION OF DRAWINGS

FIGS. 1A and 1B are conceptual view of an embodiment of a nozzle structure of the present invention, wherein: FIG. 1A depicts an example of the nozzle structure comprising an upper nozzle, an upper plate, a middle plate, a lower plate, a lower nozzle, and an immersion nozzle, and FIG. 1B depicts an example of the nozzle structure comprising an upper nozzle, and an immersion nozzle.

FIGS. 4A and 4B are conceptual view of an embodiment of an inner bore sleeve of the present invention, wherein: FIG. 4A depicts a top plan view thereof, and FIG. 4B depicts a longitudinal sectional view thereof.

DESCRIPTION OF EMBODIMENTS

Figure 1A:
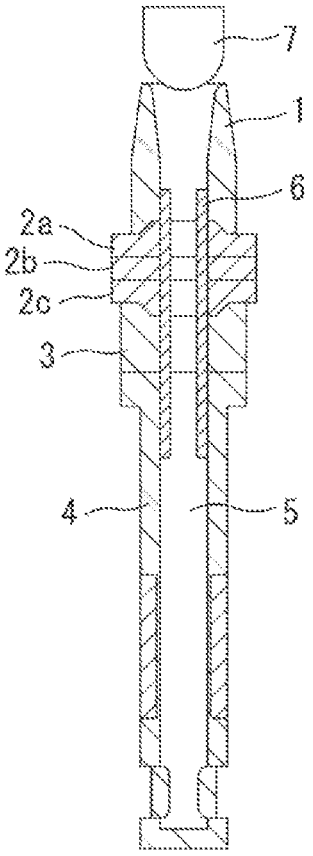
Figure 1B:
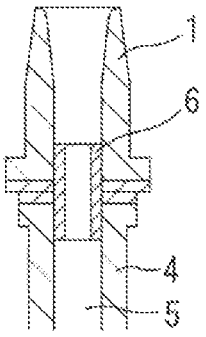

A typical embodiment of a nozzle structure of the present invention having the largest number of divisions or number of joints comprises a refractory body (nozzle body) which comprised of a plurality of refractory members (nozzle members) such as an upper nozzle, a sliding nozzle plate of three layers (upper plate, middle plate, lower plate), an middle nozzle, a lower nozzle, and an immersion nozzle. However, the present invention should be not limited to this embodiment, but may be any of the embodiments in which any two or more of the respective refractory members (nozzle members) are combined. For example, FIG. 1A depicts an embodiment of a nozzle structure comprising an upper nozzle 1, an upper plate 2*a*, a middle plate 2*b*, a lower plate 2*c*, a lower nozzle 3, and an immersion nozzle 4, and FIG. 1B depicts an embodiment of a nozzle structure comprising an upper nozzle 1 and an immersion nozzle 4. More specifically, the present invention provides a nozzle structure for discharging molten steel, wherein the nozzle structure comprises: a molten steel discharge path having an inner bore 5; and one or more joints through which the molten steel discharge path is divided at one or more positions in a orthogonal direction with respect to an upward-downward direction of discharge of molten steel, and which join the molten steel discharge path. The nozzle structure of the present invention further comprises an inner bore sleeve 6 formed of a refractory material, and provided on an inner bore surface of the nozzle structure to extend in the upward-downward direction across at least one of the joints.

The inner bore sleeve 6 ensures sealing performance of the nozzle structure. In order to further enhance the sealing performance, most preferably, the inner bore sleeve 6 is formed as an integral structure without dividing it in a direction orthogonal to an upward-downward direction, and then is provided so as to extend across all of the joints in the upward-downward direction. However, the inner bore sleeve provided so as to extend across at least one of the joints in the upward-downward direction, can also contribute to an enhanced sealing performance.

Figure 2:
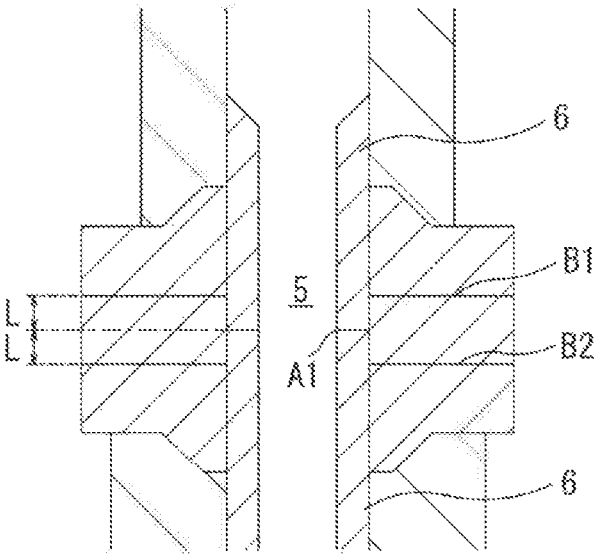
FIG. 2 is a conceptual view of an embodiment of a nozzle structure of the present invention, wherein joints through which the molten steel discharge path is divided at one or more positions in a orthogonal direction with respect to an upward-downward direction of discharge of molten steel and which join the molten steel discharge path, do not coincide with joints of an inner bore sleeve in terms of a position in the upward-downward direction.

Further, as shown in FIG. 2, the inner bore sleeve 6 may be divided into a plurality of pieces in a direction orthogonal to an upward-downward direction. However, in the case of such a divided configuration, it is necessary to prevent the divided portion, i.e., a joint A1 of the inner sleeve from being aligned with the divided portions, i.e., joints B1 and B2 of the molten steel discharge path, which is a nozzle body of the nozzle structure. In other words, as used in the present invention, the description that the inner bore sleeve is provided to extend across the joints in the upward-downward direction, means that the inner bore sleeve is a continuous body in which the inner bore sleeve is not divided in the upward-downward direction at a position opposed to each of the one or more joints in a direction orthogonal to the upward-downward direction. Moreover, in order to effectively suppress drawing of outside air (gas) from an outside of the nozzle structure, an offset distance in the upward-downward direction between the joint A1 of the inner bore sleeve 6 and the joins B1, B2 of the nozzle body is empirically preferably greater than or equal to a thickness of the inner bore sleeve 6.

Figure 3:
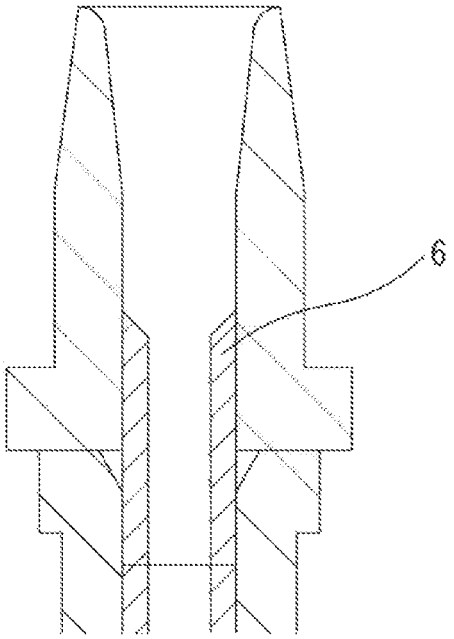
FIG. 3 is a conceptual view of an embodiment of a nozzle structure of the present invention, wherein a nozzle (refractory member) provided at relatively lower side has a notch in the upper end of an inner bore surface of the nozzle, that is, it has an inclined or curved surface downward toward the inner bore side.

Further, when attaching the inner bore sleeve, it is necessary that each of the nozzle members (refractory member) constituting the nozzle structure accurately exists at a given position in a direction orthogonal to the upward-downward direction. The given position for each nozzle member is determined by a set of the nozzle members or the like. However, as shown in FIG. 3, for example, at the upper end of the inner bore surface of the nozzle member attached relatively below, it is preferable to provide a notch having a length equal to or greater than the relative accuracy in the orthogonal direction between the upper nozzle member and the lower nozzle member, that is, a portion having an inclined or curved surface downward toward the inner bore side. Thus, when inserting the inner bore sleeve from above into the inner bore of the nozzle structure, the inner sleeve can be smoothly attached.

Figure 4A:
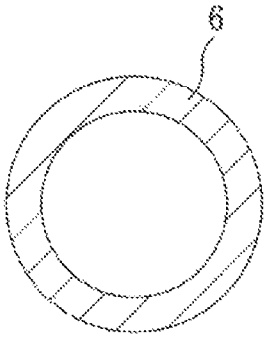
Figure 4B:
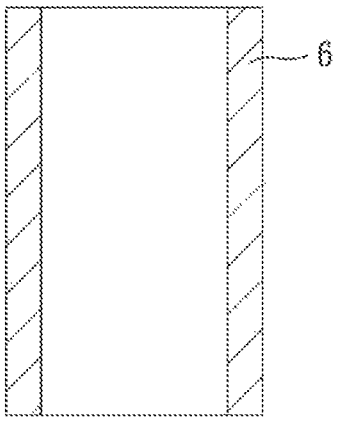
Figure 5:
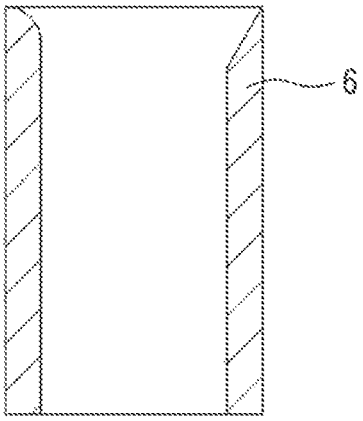
FIG. 5 is a conceptual longitudinal sectional view of an embodiment of an inner bore sleeve of the present invention, wherein an inner side (inner bore-side) upper end of the inner bore sleeve has a curved or inclined surface.

Although the inner bore sleeve 6 typically has a cylindrical shape as shown in FIGS. 4A and 4B, preferably, the upper end on the inner bore side thereof has a curved or inclined surface as shown in FIG. 5, that is, has an angle as small as possible or a gradually-increasing shape with respect to the discharge direction of the molten steel. If the inner bore sleeve has a large-angled stepped structure such as a surface in the direction orthogonal to the discharge direction of the molten steel, the flow of the molten steel is greatly disturbed at that portion, and as the result, adhesion of inclusions, local damage of the inner bore sleeve or the like can occur.

Figure 6:
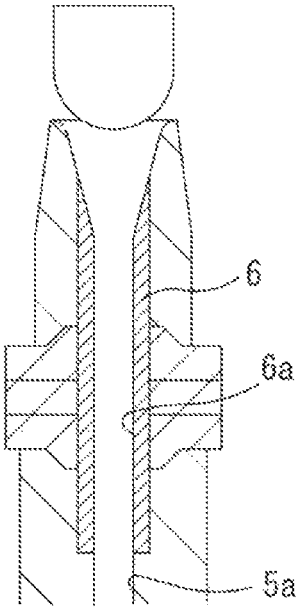
FIG. 6 is a conceptual view of an embodiment of a nozzle structure of the present invention, wherein an inner bore surface of the inner bore sleeve attached inside the nozzle structure is flush with an inner bore surface of the nozzle structure.

As shown in FIG. 6, an inner bore surface 6*a* of the inner bore sleeve 6 can be flush with the inner bore surface 5*a* of the nozzle structure. This allows the stepped portions of the inner bore surfaces at the upper end and a lower end of the inner bore sleeve 6 to eliminate.

Figure 7:
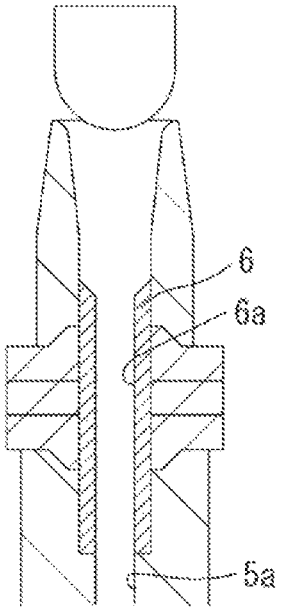
FIG. 7 is a conceptual longitudinal sectional view of an embodiment of a nozzle structure of the present invention, wherein the inner bore surface of the inner bore sleeve attached inside the nozzle structure is only at the lower end thereof, flush with the inner bore surface of the nozzle structure.

As shown in FIG. 7, it is also possible to eliminate the stepped portion of the inner bore surface only at the lower end of the inner bore sleeve 6. This stepped portion at the lower end can also serve as a base point at which disturbance of the flow of molten steel such as vortex occurs at this portion. In such a case, it is possible to suppress the turbulence of the molten steel flow even by merely eliminating the stepped portion of the inner bore surface only at the lower end of the inner bore sleeve 6. Further, by setting the lower end of the inner bore sleeve 6 to have the same diameter as the inner bore surface 5*a* of the nozzle body (to be flush with the inner bore surface 5*a*), it is possible to prevent the inner bore sleeve 6 from falling downward or slipping downward. Furthermore, in order to prevent the inner bore sleeve 6 from falling downward or slipping downward, the inner bore surface 5*a* of the nozzle structure near the lower end of the inner bore sleeve 6 may be provided with a protruding portion and an inclined portion.

Figure 8:
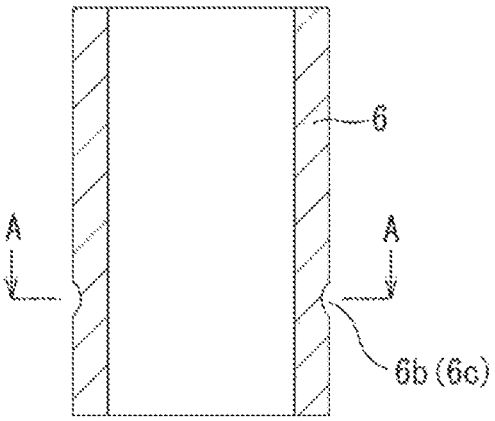
FIG. 8 is a conceptual longitudinal sectional view of an embodiment of an inner bore sleeve of the present invention, wherein one or separated recesses or one groove are/is provided on a part of the outer periphery of the inner bore sleeve.
Figure 9:
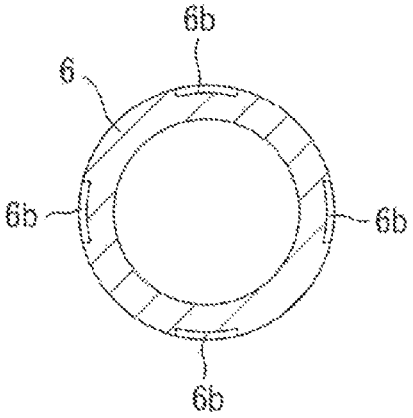
FIG. 9 is a conceptual view from A-A section of FIG. 8, wherein four separated recesses are provided on a part of the outer periphery of the inner bore sleeve in FIG. 8.
Figure 10:
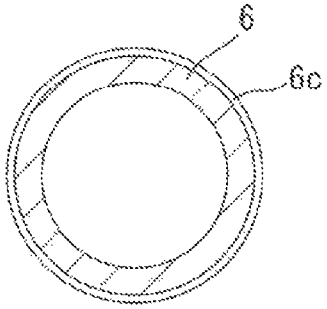
FIG. 10 is a conceptual view from A-A section of FIG. 8, wherein a continuous groove in a circumferential direction is provided on a part of the outer periphery of the inner bore sleeve in FIG. 8.
Figure 11:
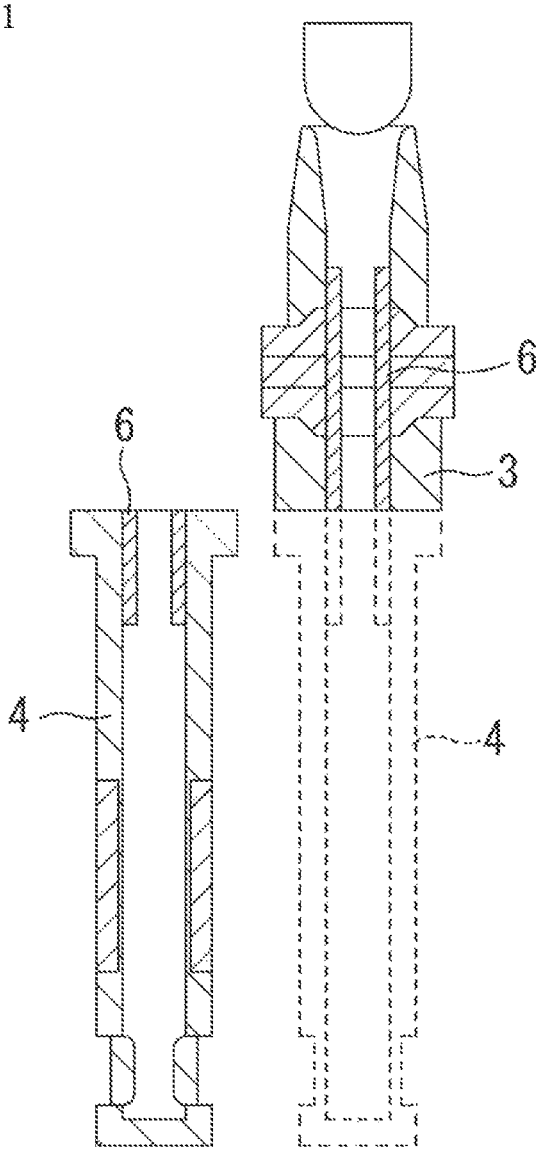
FIG. 11 is a conceptual view, of an embodiment of the nozzle structure of FIG. 1(*a*) wherein the inner bore sleeve is broken and then the immersion nozzle is detached at the upper end of joining surface, and of an embodiment in the case where the inner bore sleeve is attached in the region from the molten steel inlet port to the upper end of the immersion nozzle.
Figure 12:
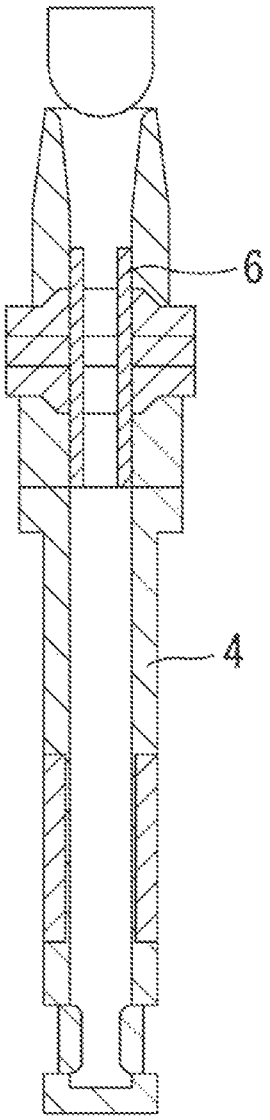
FIG. 12 is a conceptual longitudinal sectional view of an embodiment of a nozzle structure of the present invention, in a case where a new immersion nozzle is attached after detaching the immersion nozzle as in FIG. 2.
Figure 13:
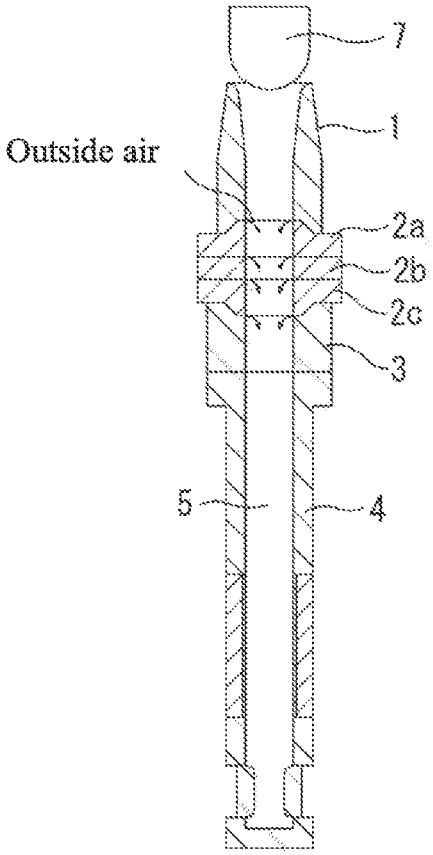
FIG. 13 is a conceptual view of, an embodiment of a nozzle structure having joints comprising a conventional upper nozzle, a sliding nozzle plate having a three-layer structure, a lower nozzle and an immersion nozzle, and an embodiment in the case where outside air is drawn from the joints.
Figure 14:
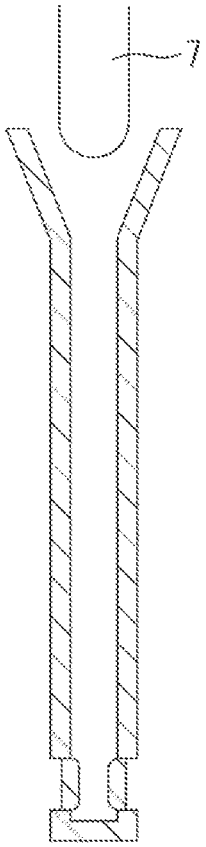
FIG. 14 is a conceptual view of an embodiment of an integral structure nozzle (immersion nozzle) with no joint.

As shown in FIG. 8, the inner bore sleeve 6 may be provided with one or more non-continuous recesses 6*b* or continuous grooves 6*c* on an outer periphery thereof. For example, in an embodiment of FIG. 9, four separated recesses 6*b* are provided on a part of the outer periphery of the inner bore sleeve 6, and in an embodiment of FIG. 10, a continuous groove 6*c* in a circumferential direction is provided on a part of the outer periphery of the inner bore sleeve 6. The recesses 6*b* and the continuous groove 6*c* are provided on the outer periphery of the inner bore sleeve 6 at a position opposed to each of the joints of the nozzle body in the orthogonal direction. The reason for the above is as follows. First, in the case of detaching the immersion nozzle 4 at a position of the joining surface on the upper end thereof as shown in FIG. 11, for example, in the event of emergency or for replacing a part of the refractory members (parts) of the nozzle structure, if the inner bore sleeve 6 is attached inside the nozzle, the inner bore sleeve 6 may be broken at an irregular position in a complicated form, and breakage itself may be difficult to perform. Therefore, as described above, by providing the recesses 6*b* and the groove 6*c* on the outer periphery of the inner bore sleeve 6 at a position opposed to each of the joints of the nozzle body in the orthogonal direction (in the case of FIG. 11, at a position opposed to the upper end of the immersion nozzle 4 in the orthogonal direction), the inner bore sleeve 6 can be easily broken, and further can be broken with high accuracy from a desired predetermined position (see FIG. 12).

The above "emergency" includes a case where an abnormality occurs in the stopper control, so that the nozzle is closed at a location other than the stopper in order to stop the molten steel flow, for example, a case where a part of the nozzle structure is slidable and the inner bore sleeve is broken and removed at a sliding portion by sliding. Further, the above "replacing a part of the refractory members (parts) of the nozzle structure" includes, for example, a case where the immersion nozzle is slid in a direction orthogonal (orthogonal direction) to an upward-downward direction or a mechanical load is applied diagonally downward to the immersion nozzle, thereby breaking the bore sleeve and detaching the immersion nozzle, and after sliding another new immersion nozzle in the orthogonal direction or attaching it from below. In any of these cases, preferably, the inner sleeve can be easily broken with high precision and little unevenness.

Preferably, among the recesses 6*b* and the grooves 6*c*, an area of the recesses or continuous grooves which are arranged on at least one of front and back surfaces of the inner bore sleeve along a sliding direction of a nozzle or along a pressure-applied direction for disassembling and removing the nozzle below the joints, is greater than that of the remaining recesses or continuous grooves. This is because the outer periphery portion of the outer sleeve along the sliding direction or the pressure-applied direction becomes the origin of the stress.

Preferably, the inner bore sleeve 6 is provided on the inner bore surface of the nozzle structure via an adhesive. Although providing the inner bore sleeve 6 reduces the risk of drawing of gas, in the case of not using the adhesive, it is necessary to take measures such as enhancing the surface accuracy of the joining surface to the extent that gas does not pass through. This is impractical measures in terms of cost.

The adhesive (mortar) can be used without particular limitation as long as it is a material generally used for a nozzle structure, such as a material which does not cause melting or the like depending on the composition of the nozzle structure. According to empirical knowledge of the inventors of the present invention, for example, when mortar having an apparent porosity of about 30% or less after heat treatment at a temperature of about 1000° C. to 1400° C. is used, gas or the like may not pass through to the inner bore.

On the other hand, deposition or growth of non-metallic inclusions such as alumina or metals on the inner bore surface of the inner sleeve 6 adversely affects the quality and productivity of the steel in operation, such as disturbance of the flow of molten steel during casting and reduction of casting speed. Furthermore, it is difficult to disassemble or detach the nozzle members including the immersion nozzle. Then, the material of the inner bore sleeve 6 is designed to have higher anti-deposition capability than a refractory material of the nozzle body of the nozzle structure, thereby making it possible to reduce deposition of alumina inclusions and the like onto the inner bore surface, and more to reduce deposition or growth of metal on it. The material having high anti-deposition capability includes a refractory material containing about 15 mass % or more of a CaO component and a remainder including refractory components such as MgO, $ZrO_2$, and Carbon, wherein a mass ratio of CaO/MgO is the range of 0.1 to 1.5; material containing or adjusting the chemical composition that reacts with other molten steel and components in the molten steel to smooth the surface; or material with improved surface smoothness.

Although, in the above embodiments, the nozzle structure for discharging the molten steel from the tundish to the mold has been illustrated herein as an example, the present invention is not limited to the use for the tundish, and may be applied to other nozzle structures for discharging the molten steel.

EXPLANATION OF CODES

1: upper nozzle
2*a*: upper plate
2*b*: middle plate
2*c*: lower plate
3: lower nozzle
4: immersion nozzle
5: inner bore
5*a*: inner bore surface
6: inner bore sleeve
6*a*: inner bore surface
6*b*: recess
6*c*: groove
7: stopper

The invention claimed is:

1. A nozzle structure for discharging molten steel, wherein the nozzle structure comprises:

a nozzle body having a molten steel discharge path thereinside, and comprising a plurality of nozzle members arranged to divide the molten steel discharge path at one or more positions in an orthogonal direction with respect to an upward-downward direction and joined together through one or more joints, wherein at least one of the nozzle members is slidable in the orthogonal direction with respect to the upward-downward direction during casting operation; and;

an inner bore sleeve formed of a refractory material, and provided on an inner bore surface of the nozzle structure to extend in the upward-downward direction across at least one of the joints which joins the at least one nozzle member slidable in the orthogonal direction with respect to the upward-downward direction during casting operation, and an adjacent one of the remaining one or more nozzle members.

2. The nozzle structure as recited in claim 1, wherein the inner bore sleeve is provided on the inner bore surface via an adhesive.

3. The nozzle structure as recited in claim 1 or 2, wherein an inner bore-side upper end of the inner bore sleeve has a curved or inclined surface.

4. The nozzle structure as recited in claim 1, wherein the inner bore sleeve comprises one or more non-continuous recesses or continuous grooves provided on an outer periphery of the inner bore sleeve at a position opposed to each of the one or more joints in the orthogonal direction.

5. The nozzle structure as recited in claim 4, among the one or more non-continuous recesses or continuous grooves, an area of the recesses or continuous grooves which are arranged on at least one of front and back surfaces of the inner bore sleeve along a sliding direction of a nozzle or along a pressure-applied direction for disassembling and removing the nozzle below the joints, is relatively greater than that of the remaining recesses or continuous grooves.

6. The nozzle structure as recited in claim 1, wherein the refractory material of the inner bore sleeve has higher anti-deposition capability than that of a nozzle body of the nozzle structure.

7. The nozzle structure as recited in claim 6, wherein the inner bore sleeve is composed of a refractory material containing about 15 mass % or more of a CaO component and a remainder including MgO, wherein a mass ratio of CaO/MgO is the range of 0.1 to 1.5.

8. The nozzle structure as recited in claim 2, wherein an inner bore-side upper end of the inner bore sleeve has a curved or inclined surface.

9. The nozzle structure as recited in claim 2, wherein the inner bore sleeve comprises one or more non-continuous recesses or continuous grooves provided on an outer periphery of the inner bore sleeve at a position opposed to each of the one or more joints in the orthogonal direction.

10. The nozzle structure as recited in claim 3, wherein the inner bore sleeve comprises one or more non-continuous recesses or continuous grooves provided on an outer periphery of the inner bore sleeve at a position opposed to each of the one or more joints in the orthogonal direction.

11. The nozzle structure as recited in claim 2, wherein the refractory material of the inner bore sleeve has higher anti-deposition capability than that of a nozzle body of the nozzle structure.

12. The nozzle structure as recited in claim 3, wherein the refractory material of the inner bore sleeve has higher anti-deposition capability than that of a nozzle body of the nozzle structure.

13. The nozzle structure as recited in claim 4, wherein the refractory material of the inner bore sleeve has higher anti-deposition capability than that of a nozzle body of the nozzle structure.

14. The nozzle structure as recited in claim 5, wherein the refractory material of the inner bore sleeve has higher anti-deposition capability than that of a nozzle body of the nozzle structure.

* * * * *